US007055275B1

(12) United States Patent
Teza et al.

(10) Patent No.: US 7,055,275 B1
(45) Date of Patent: Jun. 6, 2006

(54) WALL-MOUNTED DISPLAY ASSEMBLY FOR SIMULTANEOUSLY DISPLAYING A PLURALITY OF ITEMS

(76) Inventors: Coral Cole Teza, 3105 Caminito Ricardo, Encinitas, CA (US) 92024; Robert G. Salatka, 457 Arden Dr., Encinitas, CA (US) 92024

( * ) Notice: Subject to any disclaimer, the term of this patent is extended or adjusted under 35 U.S.C. 154(b) by 0 days.

(21) Appl. No.: 11/013,892

(22) Filed: Dec. 15, 2004

(51) Int. Cl.
*A47G 1/06* (2006.01)

(52) U.S. Cl. ..... 40/735; 40/674; 40/739

(58) Field of Classification Search ..... 40/649, 40/657, 674, 735, 739, 765, 611.06, 611.13, 40/661.03, 790
See application file for complete search history.

(56) References Cited

U.S. PATENT DOCUMENTS

| | | | | | |
|---|---|---|---|---|---|
| 1,539,633 | A | | 5/1925 | Benton et al. | |
| 1,621,262 | A | | 3/1927 | MacQuarrie | |
| 2,815,594 | A | * | 12/1957 | Heselov | 40/650 |
| 2,990,196 | A | * | 6/1961 | Slavsky | 40/5 |
| 3,296,724 | A | * | 1/1967 | Deuchar | 40/661.03 |
| 3,706,150 | A | * | 12/1972 | Greenberger | 40/661.03 |
| 3,846,925 | A | * | 11/1974 | Busse | 40/650 |
| 3,969,838 | A | * | 7/1976 | Moore | 40/611.06 |
| 3,977,112 | A | | 8/1976 | Breer, II | |
| 3,981,092 | A | * | 9/1976 | Ramsdale | 40/709 |
| 4,035,980 | A | | 7/1977 | Lucas | |
| 4,115,938 | A | | 9/1978 | Belmuth et al. | |
| 4,187,630 | A | | 2/1980 | Giulie et al. | |
| 4,344,244 | A | * | 8/1982 | Tyke | 40/611.05 |
| 4,450,955 | A | * | 5/1984 | Featherston | 206/39.6 |
| 4,532,727 | A | | 8/1985 | Klose et al. | |
| 4,676,016 | A | | 6/1987 | Phillips et al. | |
| 4,831,759 | A | | 5/1989 | Hosey | |
| 5,044,103 | A | | 9/1991 | Izenberg | |
| 5,189,822 | A | * | 3/1993 | Schmanski et al. | 40/611.05 |
| 5,199,199 | A | * | 4/1993 | Garfinkle | 40/5 |
| 5,205,059 | A | | 4/1993 | Doll | |
| 5,465,516 | A | * | 11/1995 | Stabile | 40/649 |
| 5,666,751 | A | | 9/1997 | Garfinkle | |
| 5,881,484 | A | * | 3/1999 | Carroll | 40/649 |
| 5,903,992 | A | | 5/1999 | Eisenberg | |
| 6,076,295 | A | | 6/2000 | Garfinkle | |
| 6,393,748 | B1 | * | 5/2002 | Cooper | 40/610 |
| 6,467,209 | B1 | | 10/2002 | Vickers | |
| 6,493,974 | B1 | * | 12/2002 | Tramont | 40/606.19 |
| D487,356 | S | | 3/2004 | Gasparian | |
| 2003/0208938 | A1 | | 11/2003 | Cink et al. | |
| 2005/0039365 | A1 | * | 2/2005 | Rosa | 40/649 |

* cited by examiner

*Primary Examiner*—Gary C. Hoge
(74) *Attorney, Agent, or Firm*—Knobbe, Martens, Olson & Bear, LLP

(57) ABSTRACT

An elongated display assembly for removably inserting and simultaneously displaying a plurality of separate flexible and generally flat items to be displayed comprises an elongated open display housing having a flat back panel with an upper front flange and a lower front flange extending along the length and an upper channel and a lower channel extending along the length between the flat back panel, upper front flange and the lower front flange. The channels are for receiving upper and lower respective edges of items to be displayed. The back panel has an elongated score or notch extending along its length capable of separating the panel into an upper frame member and a lower frame member. The front of the display housing is open for removably securing a plurality of separate display items from the front.

18 Claims, 2 Drawing Sheets

WALL-MOUNTED DISPLAY ASSEMBLY FOR SIMULTANEOUSLY DISPLAYING A PLURALITY OF ITEMS

BACKGROUND OF THE INVENTION

Field of the Invention

Display of personal memorabilia such as photos, children's drawings, various trip or vacation-related items such as tickets, maps, postcards and the like is often relegated to mounting such items on a wall using thumb tacks, scotch tape and the like. Seasonal items such as Christmas cards are often similarly displayed. Presently, there exists no convenient frame devices for conveniently mounting and simultaneously displaying such items on a wall in a neat, orderly, efficient, convenient and attractive manner.

SUMMARY OF THE INVENTION

Described herein is a display assembly capable of front loading for removably inserting and simultaneously displaying a plurality of separate and generally flat items comprising an elongated open front display housing having a flat back panel extending along the entire length of the housing. A front flange extends along the upper edge from the back panel and a lower front flange extends along the lower edge of the back panel, an upper and lower channel, respectively, formed between the back panel and the upper and lower front flanges. In one embodiment the housing comprises an upper frame member and a lower frame member joined at each end by end caps. In another embodiment the back panel is scored or notched along its length whereby the panel is capable of being separated to produce the upper and lower frame members. Thus, the upper and lower frame members are substantially identical, but are opposites. The front of the elongated display housing is open between the upper and lower flanges whereby a flexible item to be displayed can be easily inserted directly from the front. A plurality of such items may be simultaneously displayed along the length of the elongated display housing. The assembly may also include a transparent flexible cover to provide protection for the display items. In a further preferred embodiment, end caps are used at each end of the display assembly, the end caps having a feature for maintaining the upper and lower separated members substantially parallel and in maintaining the desired separation or space between the upper and lower members. In another preferred embodiment, the end members are scored or notched whereby the length of each member may be selectively altered.

DETAILED DESCRIPTION OF THE PREFERRED EMBODIMENT

Figure 1:
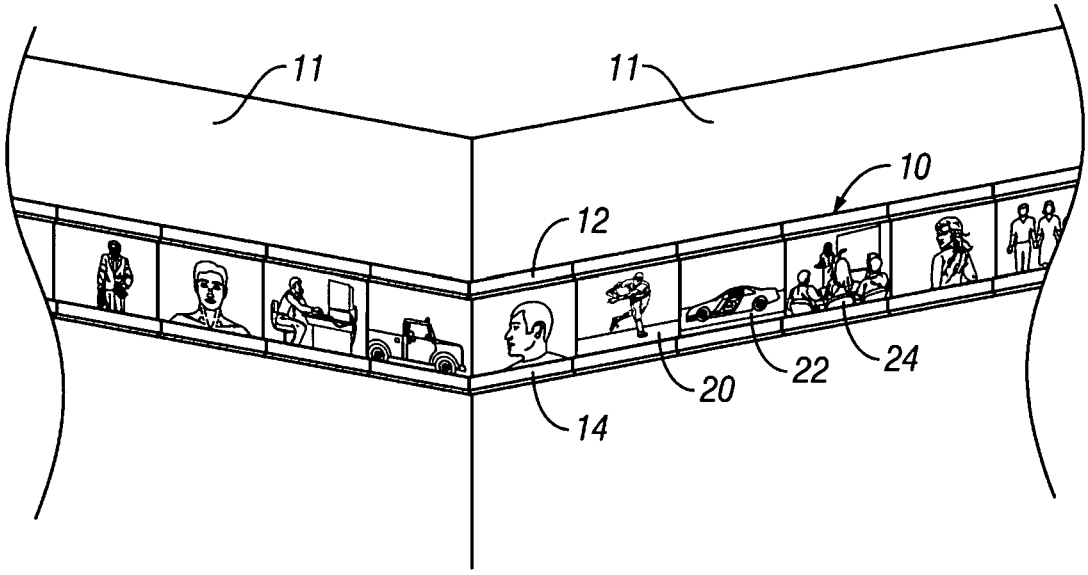
FIG. 1 illustrates a display assembly of the invention mounted on walls.
Figure 2:
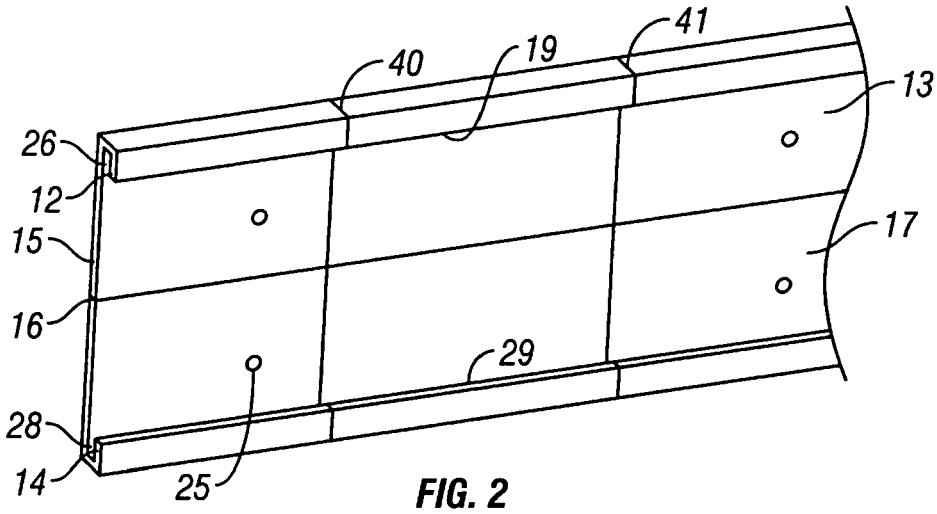
FIG. 2 is a front perspective view of a portion of one end of the display assembly.
Figure 7:
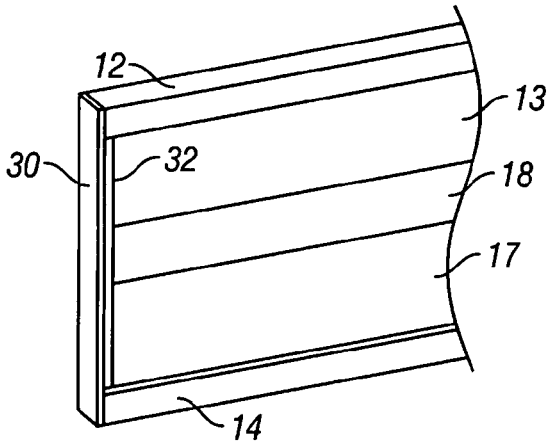
FIG. 7 shows display housing ends with an end cap secured.

FIG. 1 illustrates the display assembly 10 described herein installed on walls 11. A plurality of items 20, 22 and 24 to be simultaneously displayed within the display assembly are shown. Observing also FIGS. 2 and 3, the display assembly comprises an elongated housing having a flat back panel 15, an upper elongated flange 12 and a lower elongated flange 14, each of which extends the length of the elongated housing. Between the upper and lower flanges and the back panel are upper and lower channels 26 and 28, respectively, which provide a space in which the edges of the items to be displayed are received whereby the upper and lower flanges retain and secure the display items. The display assembly comprises separate upper and lower frame members or a housing comprising a back panel which is notched or scored along its length so that it can be separated into upper and lower frame members. Such separate upper and lower frame members are illustrated in FIG. 7. FIG. 2 illustrates a housing having a scored or notched back panel capable of being separated.

Figure 3:
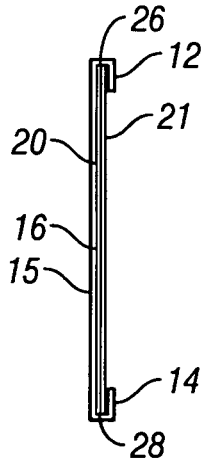
FIG. 3 is an end view of the assembly illustrated in FIG. 2.

As shown in FIG. 2, back panel 15 is scored or notched along its length, notch or score 16 being shown in FIGS. 2 and 3, whereby the housing can be separated along the score or notch to form separate and separated upper and lower frame members. The notch or score 16, although shown as formed substantially parallel with the upper and lower flanges 12 and 14, need not necessarily be formed as a straight parallel line along the back panel. Instead, it may be saw-toothed or a wave form, or other shaped notch capable of separating the back panel into upper and lower frame member segments. Such a feature is especially useful to allow display of items having different sizes. For example, where photographs or cards are of a vertical dimension that is greater than the vertical distance along the back panel which has not been separated along the notch, the back panel simply can be broken and separated along the score or notch to form a space whereby the vertical dimension of the frame may be adjusted to conveniently fit larger or smaller sized items.

FIG. 3 illustrates the use of a transparent cover 21 which is preferably a flexible transparent film for protecting and further retaining the items to be displayed. Such a film may include ultraviolet protection to prevent fading of the displayed items as well as to prevent bowing, shriveling, bending, or other deformation of the substantially flat items once they are inserted and displayed in the housing. Such a flexible and bendable transparent film is made of sheet plastic which will return to and retain its substantially flat shape after it is installed between the upper and lower flanges to prevent such deforming of the items. Especially where the items to be displayed comprise thin paper items such as children's drawings or writings, recipes, maps, magazine pages or covers and the like which often sag or are otherwise deformed when placed in a frame without a cover, the displayed items will be maintained substantially flat between the film 21 and the back panel 15.

The upper and lower flanges 12 and 15 are shown as having substantially linear and parallel front edges 19 and 29. However, instead such front edges may be scalloped or wave-shaped, notched or saw-toothed or any other desirable design. It is only important that the vertical dimension of the upper and lower front flanges be sufficient to maintain the inserted items as well as the protective transparent front film in place. Moreover, the items to be displayed need not necessarily have straight upper and lower opposing edges, nor do such upper and lower edges of the items to be displayed necessarily need to be parallel or linear since they will be maintained in place by the transparent plastic cover. The display items may be placed end to end or may be inserted with spaces between the edges as desired to create any pleasing or desired display. Moreover, such a display may not necessarily include items of the same form or shape, and thus combinations and variations of different items may be inserted and displayed. For example, items from a recent trip including airline tickets, maps, theater tickets, flags and photographs may be mixed and matched as desired. Other seasonal displays which would include holiday materials and the like may be displayed.

A major advantage of the display assembly is in providing for easy and efficient insertion and removal of one or more of the items to be displayed. Because the front of the display housing is open, the items to be displayed are front loaded, whereby they can be readily inserted from the front at any location along the housing without disassembling the housing. Such insertion may be accomplished by slightly or sufficiently bending the items so that they can be tucked behind the upper and lower flanges, separately or simultaneously. Alternatively, the lower frame member may first be secured on the wall, items then placed in the space behind the lower front flange, and then the upper frame member lowered to meet and secure the upper item edges. The front cover may be similarly installed. The front transparent flexible plastic cover 21 may be segmented rather than a single elongated sheet whereby different sections of the housing and items to be displayed or removed can be readily accessed. Such a feature may be especially desirable where the display housing extends along an entire wall or otherwise along a substantial length.

Figure 4:
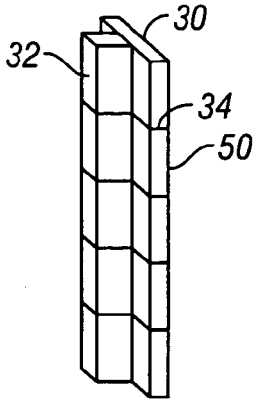
FIGS. 4, 5 and 6 illustrate different embodiments of end caps.
Figure 5:
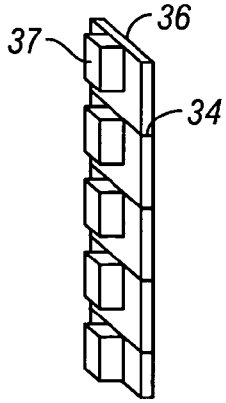
Figure 6:
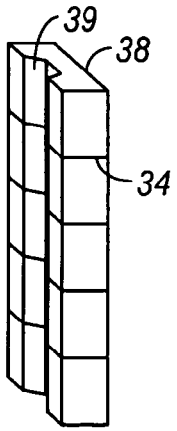

In another preferred embodiment, the display assembly includes end caps to be inserted at each end of the display housing for securing the housing, especially useful when the frame comprises separate upper and lower frame members or where the back panel is separated along the notch or score to form upper and lower housing members. Observing FIG. 2, showing the notched back panel embodiment where it is desirable or necessary to increase the vertical dimension of the display assembly, the back panel is split or separated along notch 16 whereby the housing is separated into an upper member 13 and a lower member 17. As shown in FIG. 7, a space 18 is provided between upper and lower frame members. To secure the separate upper and lower housing members in substantially parallel arrangement, end caps are used. As shown in FIG. 7, end cap 30 is installed at an end of the housing whereby the end cap maintains the upper and lower frame members in a secure and parallel spaced relationship. Different designs of end caps are illustrated in FIGS. 4, 5 and 6. In FIG. 4, end cap 30 comprising an elongated plate 50 with a block or rib 32 extending therealong is used by positioning the end plate so that upper and lower portions of block 32 are inserted into channels 26 and 28. The end cap may be formed of a somewhat resilient or deformable material such as a plastic which can be urged or force fit into the respective upper and lower end channel openings. Polypropylene and polyvinyl chloride are examples of such materials. In the embodiment shown in FIG. 4, the end cap is also provided with scores or notches 34 which provide for snapping off or, if necessary, cutting off the end cap at a desired length so that it will provide the desired secure and spatial relationship between upper and lower housing members as illustrated in FIG. 7. Any number of scores or notches may be used to achieve a number of different useful lengths of the end caps. Although the depth of such scores or notches allow the end cap to be broken by hand to the desired length, such scoring may be actually in the form of indicia or markings whereby an end cap may simply be cut using a knife or other useful cutting tool for selecting and achieving the desired end cap length to secure the desired separation of the display housing members. It will be understood by observing FIG. 7 that with an end cap secured at each end of the upper and lower frame members, these members are maintained in parallel alignment with their respective ends also secured in vertical alignment Another embodiment of an end cap is illustrated in FIG. 5 with the presence of blocks or protuberances 37 along the surface of end cap 36 for being inserted into the upper and lower channels 26 and 28 at the ends of the housing member. FIG. 6 illustrates yet another embodiment of an end cap 38 which comprises an elongated bar or slat having a groove or recess 39 formed along its length into which the ends of the housing member, including the back panel and upper and lower flanges, may be inserted. Again, a suitable deformable material which may be secured or force-fit onto the ends of the housing members may be used. The presence of one or more scores or notches 34 is also present on the end caps whereby the selection of the desired end cap length may be determined and cut or otherwise separated at the desired notch or score.

Figure 8:
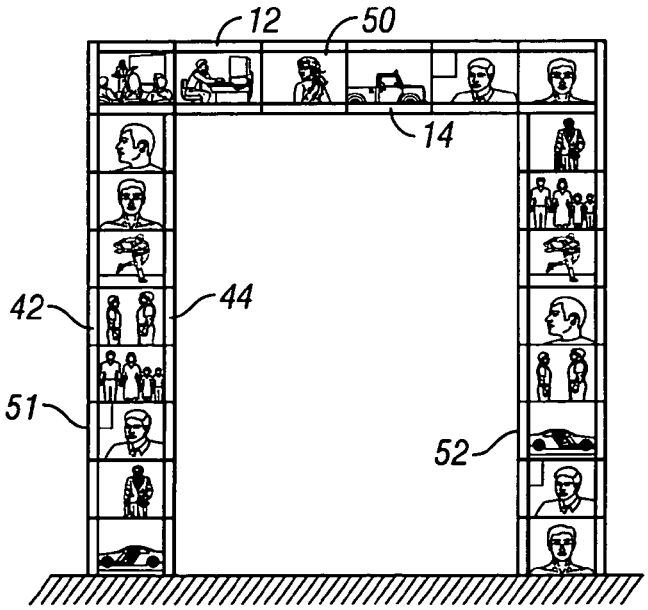
FIG. 8 illustrates another embodiment of display assembly mounted adjacent to a door frame.

In another embodiment the display assembly may be assembled around a door or door frame and/or around a window or window frame. Such an assembly will include one or more generally horizontal components and one or more generally vertical components with the components aligned and cooperating to frame a door, window or similar structure or feature. Observing FIG. 8, such an assembly is mounted along a wall around a door using a horizontal component 50 and vertical components 51 and 52. The horizontal component is substantially as previously described and shown in FIGS. 1 and 2. The structure of the vertical components is also the same except that the upper and lower frame members are mounted generally vertically, whereby an upper front flange becomes a first vertical front flange 42 and a lower front flange become a second vertical front flange 44. Items to be displayed in the vertical frame member are inserted as previously described, edge to edge or spaced apart as desired. Where edge friction of an item within the channels is insufficient to maintain a desired position, the use of tape behind an item, or along an edge will be useful.

The material used for the display housing is not so critical so long as it may be secured along a wall or other desired surface on which the display is to be mounted. Plastic is one material which may be readily molded to the design illustrated whereby the elongated housing can be extruded in any desirable lengths and readily cut and packaged. Of course, different lengths of housing may be selected and may be used and mounted or installed on a wall end-to-end so that multiple lengths may be used. Examples of suitable plastics include polypropylene and polyvinylchloride. As also illustrated in FIG. 2, the housing may include vertical notches or scores 40 and 41 at any desirable locations along the length whereby the length of the housing may be selectively altered. Again, such notches may be deep whereby the desired length can be achieved, either by breaking off or otherwise separating the sections by hand, or by cutting along the score. Of course, a sufficiently sharp cutting instrument or saw may be used to cut the housing at any desired length. FIG. 2 also illustrates the presence of holes 25 which may be formed in the back panel of the housing for installing or securing the elongated housing to a wall using screws, nails or the like. Of course, where the material of which the housing is formed is suitable, nails or screws may be driven through the back panel at any desired location. Alternatively, the housing may be glued to a wall, or even using a separating material such as Velcro, or the like.

The following is a list of examples of materials that may be installed and simultaneously displayed in the display assembly described above:

Photographs or pictures,
airline tickets,
sporting event tickets,
CD music covers,
book covers,
children's drawings,
children's writings,
theatre tickets,
recipes,
maps,
flower seed packages,
baseball cards,
postcards,
flags,
stickers,
cutouts,
magazine covers,
blueprints,
invitations,
Christmas cards,
DVD movie covers,
curtain matching fabric, and
combinations of any one or more of the above or other items.

Again, such items are preferably substantially flat and flexible enough to be bent sufficiently to be inserted between and under the upper and lower front flanges.

What is claimed is:

1. An elongated display assembly for removably securing and simultaneously displaying a plurality of separate flexible and generally flat items to be displayed therein, comprising:

an elongated open display housing comprising a flat planar back panel having an upper front flange and a lower front flange extending along the length thereof and an upper channel and a lower channel extending along the length thereof between said flat planar back panel and said upper front flange and said lower front flange, respectively, for receiving upper and lower respective edges of items to be displayed, said flat planar back panel having an elongated notch extending along the length thereof whereby said flat planar back panel is capable of being separated therealong to form separated upper and lower frame members, said flat planar back panel having a cross-sectional thickness along said notch that is less than the cross-sectional thickness of the upper and lower frame members, and wherein the front of said display housing is open between said upper front flange and said lower front flange along substantially the length thereof for removably securing a plurality of separate display items from the front thereof, and wherein said assembly includes end cap members secured at both ends thereof and whereby said upper and said lower front flanges are substantially parallel.

2. A display assembly of claim 1 including a plurality of separate flexible and generally flat items secured therealong and one or more elongated transparent covers removably secured along the length thereof between said items and said upper and lower front flanges.

3. A display assembly of claim 2 including a plurality of said display housings mounted on a substantially flat wall, one or more of said display housings mounted generally horizontally and one or more of said display housings mounted generally vertically and configured to form a display border adjacent to a door or window.

4. A display assembly of claim 3 wherein said one or more horizontally mounted display housings cooperate with said one or more vertically mounted display housings to form said display border around a door or window.

5. A display assembly of claim 1 wherein said end cap members comprise means for altering the length thereof whereby the distance between the upper and lower frame members may be selectively altered.

6. A display assembly of claim 1 wherein said end cap members comprise an elongated bar or slat having a rib extending therealong for being secured in the upper and lower channels whereby the distance between separated upper and lower frame members is maintained.

7. A display assembly of claim 6 wherein said end cap members are provided with scoring thereon substantially normal to an elongated axis thereof for selectively altering the length thereof.

8. A display assembly of claim 7 including a plurality of separate flexible and generally flat items secured therealong and one or more elongated transparent covers removably secured along the length thereof between said items and said upper and lower front flanges.

9. A display assembly of claim 1 wherein said end cap members comprise an elongated bar or slat having a plurality of protuberances therealong for being secured in said upper and lower channels whereby the distance between separated upper and lower frame members is maintained.

10. A display assembly of claim 9 wherein said end cap members are provided with scoring thereon substantially normal to an elongated axis thereof for selectively altering the length thereof.

11. A display assembly of claim 10 including a plurality of separate flexible and generally flat items secured therealong and one or more elongated transparent covers removably secured along the length thereof between said items and said upper and lower front flanges.

12. A display assembly of claim 1 wherein said end cap members comprise an elongated bar or slat having a groove therealong for securing said upper and lower flanges therein.

13. A display assembly of claim 12 wherein said end cap members are provided with scoring thereon substantially normal to an elongated axis thereof for selectively altering the length thereof.

14. A display assembly of claim 13 including a plurality of separate flexible and generally flat items secured therealong and one or more elongated transparent covers removably secured along the length thereof between said items and said upper and lower front flanges.

15. A display assembly of claim 1 wherein said end cap members are provided with scoring thereon substantially normal to an elongated axis thereof for selectively altering the length thereof.

16. A display assembly of claim 1 wherein said upper and lower frame members are separated along said elongated notch.

17. A display assembly of claim 16 wherein said end cap members are of substantially the same length.

18. A display assembly of claim 17 wherein said end cap members are of a length for maintaining substantially parallel upper and lower frame members.

* * * * *